US006925969B1

(12) United States Patent
Brown et al.

(10) Patent No.: US 6,925,969 B1
(45) Date of Patent: Aug. 9, 2005

(54) BOILER WALL BOX COOLING SYSTEM

(75) Inventors: Clinton A. Brown, Baltimore, OH (US); Stephen L. Shover, Millersport, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 10/876,132

(22) Filed: Jun. 24, 2004

(51) Int. Cl.[7] ..... F23M 5/08
(52) U.S. Cl. ..... 122/379; 122/497; 15/317; 110/182.5
(58) Field of Search ..... 122/499, 497, 122/511, 379; 134/85; 239/750, 752; 15/315, 15/316.1, 317; 110/182.5

(56) References Cited

U.S. PATENT DOCUMENTS 1,936,161 A * 11/1933 Hedrich ..... 122/4 R
3,743,916 A * 7/1973 Wessberg et al. ..... 122/390
3,875,904 A * 4/1975 Astrom ..... 122/235.13
3,943,861 A * 3/1976 Astrom et al. ..... 110/182.5
4,545,330 A * 10/1985 Covell et al. ..... 122/392
5,048,636 A 9/1991 Roehrs
6,024,028 A * 2/2000 Simonen ..... 110/182.5
6,055,943 A * 5/2000 Cochrane et al. ..... 122/6.5
6,655,397 B2 12/2003 Brown et al.

* cited by examiner

*Primary Examiner*—Gregory Wilson
(74) *Attorney, Agent, or Firm*—Brinks Hofer Gilson & Lione

(57) ABSTRACT

A wall box coupled with a wall port of a combustion device is provided. The combustion device includes a wall and an interior volume defined by the wall. The wall box includes a cooling chamber surface defining a cooling chamber located adjacent to the wall port. A cooling fluid enters the cooling chamber via an inlet and exits the cooling chamber via an outlet, and the inlet is located exterior from the combustion device, the outlet is located the exterior from the combustion device.

21 Claims, 3 Drawing Sheets

BOILER WALL BOX COOLING SYSTEM

BACKGROUND

The invention relates to a cooling assembly for a wall box for a large-scale combustion device. The wall box is located within a wall port of the combustion device in order to receive a device, such as a cleaning device or an imaging device.

During the operation of large-scale combustion devices, such as boilers that burn fossil fuels, slag and ash encrustations develop on interior surfaces of the boiler. The presence of these deposits degrades the thermal efficiency of the boiler. Therefore, it is periodically necessary to remove such encrustations. Various systems are currently used to remove these encrustations.

One such type of system includes a device referred to as a "sootblower". Sootblowers are used to project a stream of cleaning fluid, such as air, steam or water, into the interior volume of the boiler. In the case of long retracting type sootblowers, a lance tube is periodically advanced into and withdrawn from the boiler. As the lance tube is advanced into and withdrawn from the boiler, it rotates or oscillates in order to direct one or more jets of cleaning fluid at desired surfaces within the boiler. In the case of stationary sootblowers, the lance tube is always maintained within the boiler. Sootblower lance tubes project through openings in the boiler wall, referred to as wall ports. The wall ports may include a mounting assembly, such as a wall box, in order to properly position the lance tube with respect to the boiler wall.

Another such type of system includes a device commonly referred to as a "water cannon". Water cannons involve the use of a monitor or nozzle positioned within a wall port in order to eject a stream of fluid, such as water, into the interior volume of the combustion device. The water cannon nozzle typically includes a pivot joint to permit adjustment of the direction of the stream of fluid. Similarly to the sootblower, the water cannon nozzle is positioned within the wall port via a mounting assembly, such as a wall box. Unlike the sootblower, however, the water cannon nozzle preferably includes a pivotable ball joint coupled with the wall box in order to adjust the direction of the stream of fluid flowing into the boiler interior volume. Due to the presence of the pivotable ball joint, the wall port for a water cannon assembly is typically larger than the wall port for a sootblower.

Other devices, besides cleaning devices, may penetrate the boiler wall via a wall port in order to perform a desired function. One such device is an imaging device, such as an infrared imaging device. Imaging devices are often used to examine the interior volume and the interior surfaces of the boiler in order to check the boiler status or to perform maintenance on the boiler. Similarly to the cleaning devices, the imaging device typically penetrates a wall port in order to view the boiler interior volume. The imaging device may be extended into the boiler interior volume similarly to a sootblower lance, it may be coupled with a pivoting ball joint similarly to a water cannon assembly, or it may be used in any other appropriate configuration. Regardless of the configuration of the imaging device, it typically includes a mounting assembly located within the boiler wall port.

During operation of the boiler, the boiler interior volume reaches extremely high temperatures. The boiler external walls include a plurality of tubes containing a fluid, such as steam or water, that flows through the tubes and undergoes heat exchange with the boiler interior volume gases. The heated fluid may then be used for various purposes, such as a heating medium. The tubes, hereinafter referred to as steam tubes, are typically placed side-by-side with each other in order to form a substantially continuous heat-transferring medium. However, the steam tubes must be diverted or discontinued in the area near the wall port in order to permit the penetrating device, such as the sootblower lance tube, the water cannon nozzle, or the imaging device, to penetrate the wall of the boiler. As a result, the area adjacent to the wall port is more directly exposed to the heated boiler gases than other areas of the boiler wall.

Currently, the area adjacent to the wall port is at least partially protected from the heated boiler gases by various methods. One such method is to provide a heat transfer plate that conducts heat from the boiler interior volume into the steam tube. More specifically, heat shields may be located adjacent to the wall port and connected to the steam tubes in order to conduct heat from the boiler gases into the steam tubes and prevent such heat from damaging or penetrating the wall box. Similarly, a crotch plate may be located adjacent to the wall port and connected to the steam tubes in order to conduct heat from the boiler gases into the steam tubes. Another such method of protecting the wall box is to provide a layer of refractory material adjacent to the wall port in order to absorb and/or resist the boiler gas heat.

One problem with the currently-used methods of protecting the wall box is that the refractory material, the heat shields, and crotch plate may undergo part wear over time, thus lessening the respective components' effective heat-reducing capabilities. Part wear may be further hastened by the high temperatures within the boiler interior volume. Another problem with the currently-used methods is that the refractory material, the heat shields, and crotch plate, even when fully intact, may not provide enough heat-reducing properties to sufficiently protect the wall box.

As seen from above, it is desirous to provide an improved system for protecting and cooling a wall box in order to improve the performance of the wall box, in order to improve the performance of the device coupled with the wall box, and in order to prevent premature component damage of both the wall box and the device.

SUMMARY

In overcoming the disadvantages and drawbacks of the known technology, the current invention provides a cooling chamber for cooling a wall box located within a wall port of a combustion device. The combustion device, hereinafter referred to as a boiler, includes an interior volume defined by a wall. A device is coupled with the wall box in order to perform a desired function. One such device is a cleaning device that projects a cleaning fluid into the interior volume of the boiler. The cleaning device typically projects fluid into the boiler interior volume by extending into the boiler interior volume or by being pivotably mounted with the wall box. Another such device is an infrared imaging device used to generate images of the boiler interior volume and interior components. Yet another such device is a servicing device for reaching into the boiler interior volume and servicing interior components.

In order to cool the wall box from high boiler interior volume temperatures, the wall box includes a cooling chamber surface defining a cooling chamber located adjacent to the wall port. The cooling chamber includes an inlet and an outlet, wherein the inlet and the outlet are both located exterior from the combustion device.

The cooling chamber may further include a cooling fluid configured to enter the cooling chamber via the inlet and to exit the cooling chamber via the outlet. The cooling fluid is configured to absorb heat from the cooling chamber surface. Additionally, the cooling chamber may include at least one vane configured to direct the cooling fluid from the inlet of the cooling chamber to the outlet. The cooling fluid is preferably air, water, or steam.

The wall box may further include a sealing chamber surface defining a sealing chamber located adjacent to the wall port. The sealing chamber includes a sealing chamber inlet and a sealing chamber outlet, and the sealing chamber outlet is in fluid communication with the interior volume of the combustion device. The cooling chamber is located such that at least a portion of the cooling chamber is located between the combustion device and the sealing chamber.

The sealing chamber may further include a sealing fluid configured to enter the sealing chamber via the sealing chamber inlet and to exit the sealing chamber via the sealing chamber outlet. The sealing fluid flowing out of the sealing chamber outlet enters the interior volume of the combustion device. The sealing fluid is preferably air or steam. Alternatively, the sealing fluid may be any other appropriate fluid.

In another aspect of the invention, a cooling assembly is provided, including: a temperature sensor located adjacent to the wall port and configured to obtain an operating temperature; a cooling chamber surface defining a cooling chamber configured to receive a cooling fluid; and a controller configured to control a characteristic of the cooling fluid. The cooling chamber is located adjacent to the wall port. The cooling fluid is configured to adjust the operating temperature.

Furthermore, the controller may be configured to actively control the characteristic of the cooling fluid based on the operating temperature. A second temperature sensor may also be provided within the cooling chamber in order to obtain a second operating temperature. Additionally, the controller may be configured to actively control the characteristic of the cooling fluid based on the second operating temperature. In one configuration, the characteristic of the cooling fluid is the flow rate of the cooling fluid.

DETAILED DESCRIPTION

Figure 1:
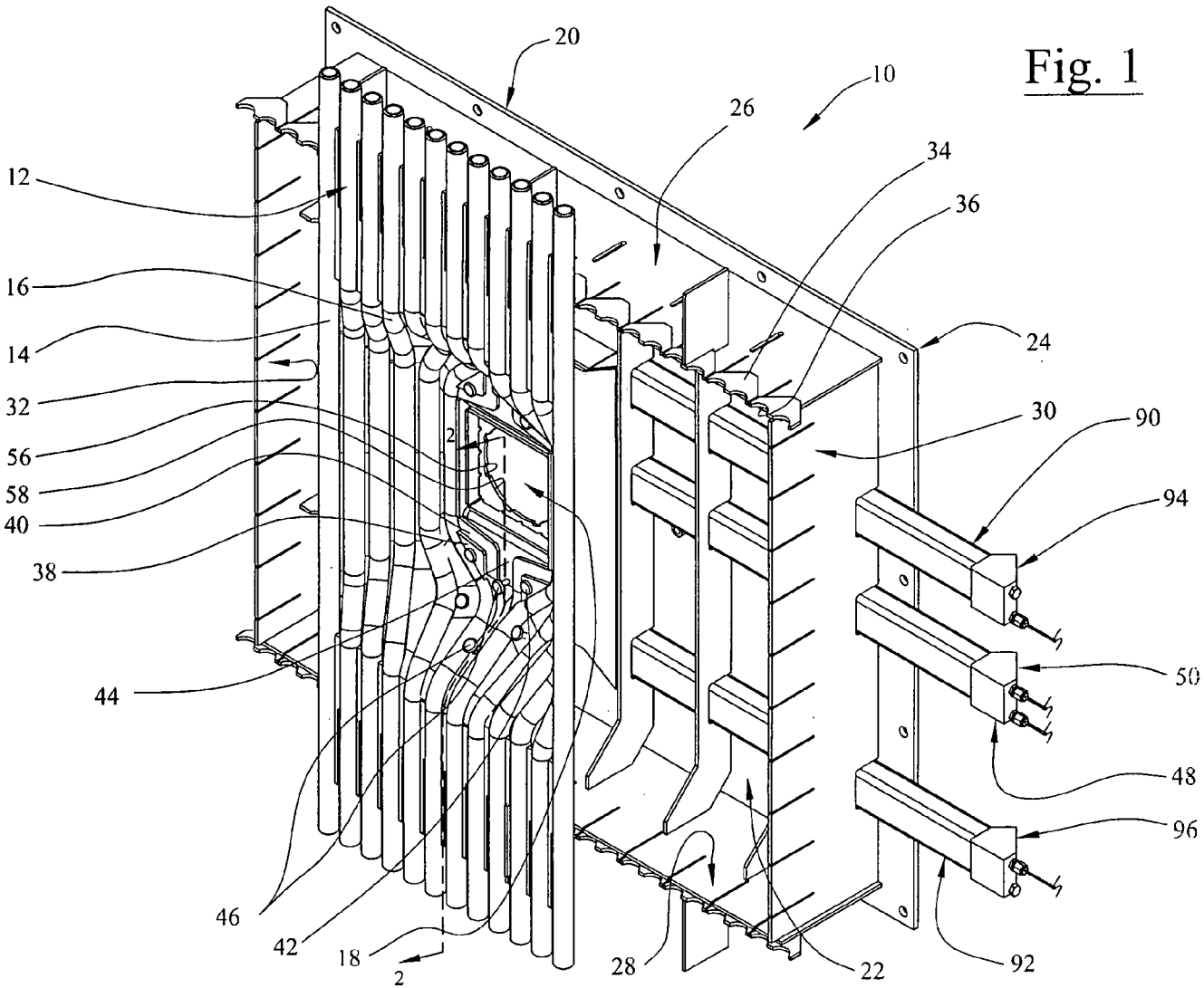
FIG. 1 is an isometric view of a wall box embodying the principles of the present invention, the wall box including a cooling chamber inlet conduit and a cooling chamber outlet conduit in fluid connection with a cooling chamber, the wall box being partially connected to a plurality of boiler tubes that partially comprise a wall of a combustion device.
Figure 2:
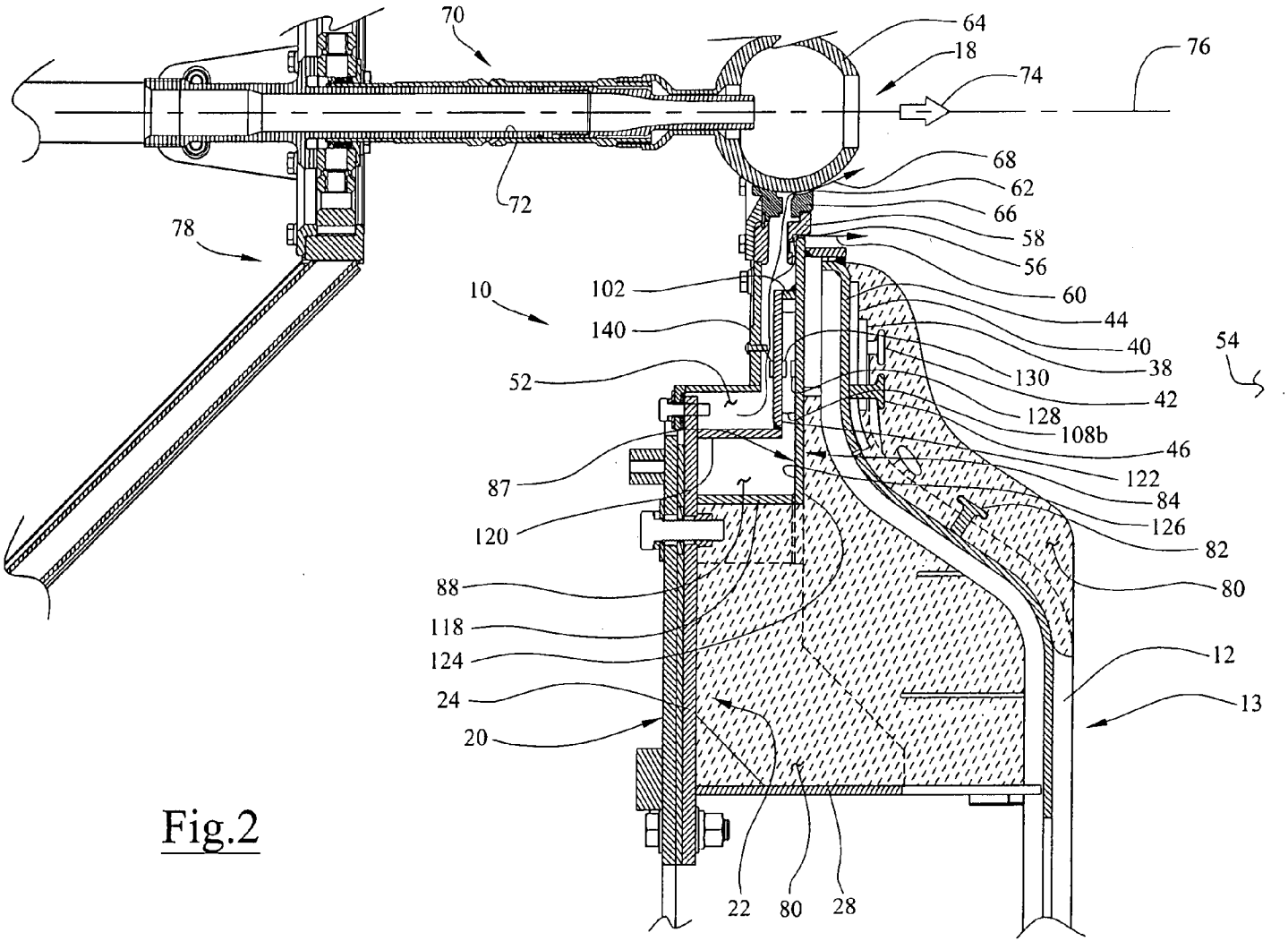
FIG. 2 is cross sectional view of the wall box taken along the line 2—2 of the wall box in FIG. 1, further including a water cannon assembly coupled with the wall box, and further being fully installed within a wall port of the combustion device.

Referring now to the present invention, FIG. 1 shows a wall box 10 partially mounted to a section of boiler tubes 12 for a combustion device wall 13 (shown in FIG. 2). As will be discussed below with respect to FIG. 2, the boiler tubes 12 are located within the wall 13 of a boiler in order to provide cooling for the walls 13 and in order to convey heat energy for some intended purpose, such as heating. The boiler tubes 12 include a section of straight tubes 14 and a section of bent tubes 16. The bent tubes 16 are respectively bent in order to form an opening, known as a wall-port 18 in the wall 13 of the boiler. The tubes 12 shown in FIG. 1 are typically welded to straight sections of tubes in order to form continuous conduits for fluid flow.

The wall port 18 is of sufficient size such that a cleaning device may be inserted into the wall port 18 in order to clean slag and ash from the interior surfaces of the boiler. As discussed above, one such cleaning device, commonly referred to as a sootblower, includes a long lance tube that is inserted into the boiler. The lance blower typically rotates or oscillates while spraying a fluid from lance tube nozzles. Sootblowers typically require a wall box opening to be slightly larger than the outer diameter of a lance tube, which is typically less than 6 inches. Another type of cleaning device, commonly known as water cannon, includes a nozzle positioned adjacent to the wall port 18. Instead of extending into the boiler interior volume, a water cannon typically includes a pivoting ball joint in order to adjust the direction of fluid stream flowing from the water cannon nozzle and into the boiler interior volume. Due to the size of the pivoting joint, water cannons typically require a larger wall port 18 than sootblowers. More particularly, water cannon wall ports 18 are typically a square shape having dimensions of 8 inches by 8 inches.

Due to the relatively small size of the wall ports 18, aspects of the present invention are not as likely to be used in connection with sootblower wall ports as they are to be used in connection with water cannon wall ports 18. However, it may be particularly advantageous to use aspects of the present invention with other devices that may require large openings, such as optical imaging devices or burners.

The wall box 10 shown in FIG. 1 includes a mounting plate 20 that mounts to the boiler tubes 12 and provides support for the cleaning device at the wall port 18. The wall box 10 includes an inner portion 22 that opens up towards the interior volume of the boiler and an outer portion 24 located outside of and facing away from the boiler wall 13. The inner portion 22 is preferably filled with an insulating material, such as refractory material designed to protect the wall box from the high temperatures of the boiler interior volume. The wall box 10 also includes a top wall 26, a bottom wall 28, a right wall 30, and left wall 32 (referring to the orientation depicted in FIGS. 1 and 3). The top and bottom walls 26, 28 are substantially perpendicular to the boiler tubes 12 and therefore preferably include boiler tube connector plates 34 that include arcuate surfaces 36 for a mating connection with the boiler tubes 12. The right and left walls 30, 32 are substantially parallel with the boiler tubes 12 and are preferably located with respect to the boiler tubes 12 such that each wall 30, 32 is aligned with a gap between two respective boiler tubes 12. The wall box 10 is preferably at least partially comprised of a high-temperature-resistant steel such RA-330, but other appropriate materials may be used. More particularly, the portions of the wall box 10 that are most directly exposed to the high temperatures of the boiler interior volume are more preferably comprised of RA-330. In order to reduce the overall cost of the assembly, other portions of the wall box 10 that are less directly exposed to the boiler interior volume are preferably comprised of a less expensive material such as carbon-based steel.

The boiler tubes 12 shown in FIG. 1 are mounted to heat-conducting devices, such as heat shields 38, 40. The heat shields 38, 40 are designed to conduct heat from the boiler interior volume into the boiler tubes 12 and away from the wall port 18. The heat shields 38, 40 preferably abut the outer surface of the boiler tubes 12 in order to conduct heat to the boiler tube outer surface. More preferably, the heat shields 38, 40 are respectively welded to the boiler tubes 12 in order to increase heat conduction between the heat shields 38, 40 and the boiler tubes 12. As discussed earlier, the boiler tubes 12 provide a conduit for a flowing, cooling fluid (not shown), such as water or steam. The heat shields 38, 40 shown in FIG. 1 have a generally triangular shape of varying sizes and are stacked upon each other such that each heat shield 38, 40 has an effective area facing the boiler interior surface. The heat shields 38, 40 are preferably held in place by the respective welds to the boiler tubes 12. Similarly to the heat shields 38, 40, a crotch plate 44 is preferably welded to the boiler tubes 12 in order to conduct heat away from the wall port 18.

The wall box 10 shown in FIG. 1 includes a wall box conduit 48 that supplies a sealing fluid from a wall box inlet 50 to the wall box 10 in order to prevent boiler gases from exiting the boiler interior volume via the wall port 18. Referring now to FIG. 2, the wall box 10 includes a sealing chamber 52 for receiving the sealing fluid from the wall box conduit 48. The sealing fluid exits the sealing chamber 52 and enters the boiler interior volume 54 via at least one opening. The sealing fluid preferably has a temperature less than that of the boiler interior volume in order to cool the surfaces defining the sealing chamber 52.

Referring back to FIG. 1, the wall port 18 includes a plurality of sealing chamber openings 56 concentrically located along a wall port plate 58. As shown in FIG. 2, the sealing chamber openings 56 permits a first stream 60 of sealing fluid to flow out of the wall box 10 and into the boiler interior volume 54, thus preventing boiler gases and other debris from entering the sealing chamber openings 56.

Another such opening for sealing fluid, as shown in FIG. 2, is a pivot joint opening 62 formed between the pivoting ball joint 64 and a pivot joint socket 66. FIG. 2 shows a second stream 68 of sealing fluid flowing out of the wall box 10 at the pivot joint opening 62 and into the boiler interior volume 54. The second stream 68 of sealing fluid preferably has a substantially continuous flow path around the outer circumference of the pivoting ball joint 64, but other appropriate configurations may be used. The second stream 68 of sealing fluid also prevents boiler debris from building-up in the pivot joint opening 62 in order to form a more effective pivot joint socket 66. The pivot joint socket 66 shown in FIG. 2 provides support the pivot joint 64 and is preferably comprised of a high-temperature resistant material, such as steel, RA-330.

The first stream 60 and second stream 68 of sealing fluid preferably exit the sealing chamber 52 with a velocity sufficient to prevent boiler gases, soot, and other debris from exiting the boiler interior volume 54 via the respective openings 56, 62.

FIG. 2 shows a water cannon assembly 70 having a water cannon lance tube 72 that sprays a cleaning fluid 74 along an axis 76 and into the boiler interior volume 54. The pivoting ball joint 64 allows the water cannon assembly 70 to inject the cleaning fluid 74 into the boiler interior volume 54 at various of angles. Although the water cannon assembly 70 is typically referred to as such, the cleaning fluid 74 may be any appropriate fluid, such as water, air, or steam. The water cannon assembly 70 includes a steering mechanism 78 to manually or automatically control the angle of the water cannon axis 76. Although FIG. 2 shows a water cannon assembly 70, an alternate cleaning device such as a soot-blower lance tube may also be used in an embodiment of the present invention.

FIG. 2 also shows various components designed to passively protect the wall box 10 and the adjacent structures from the high temperatures within the boiler interior volume 54. As discussed above, the heat shields 38, 40 and the crotch plate 44 engage the boiler tubes 12 in order to conduct heat away from the wall box 10. Additionally, refractory material 80 is located between the front portion 22 of the wall box 10 and the boiler tubes 12 as well as between the boiler tubes 12 and the boiler interior volume 54. The refractory material 80 protects the wall box 10 from the high temperatures of the boiler interior volume 54 by acting as a thermal insulator. The refractory material 80 is preferably only located adjacent to the bent portions of the bent tubes 16 in order to expose the straight sections of the tubes 12 to the boiler interior volume. The refractory material 80 is preferably comprised of a ceramic material, but other materials may be used.

In order to form a more secure connection between the refractory material 80 and the wall box 10, saddle-horns 42 are preferably welded to the heat shields 38, 40. More specifically, the saddle-horns 42 preferably include enlarged-diameter head portions 82 that provide an anchor-type connection for the refractory. Alternatively, a T-shaped component or a plate having a plurality of bent portions may be used as saddle-horns. Similarly, saddle-horns 46 having enlarged-diameter head portions are also preferably welded to the crotch plate 44. The saddle-horns 46 may include similar alternative configurations.

Passive heat-protection components, such as the heat shields 38, 40, the crotch plate 44, and the refractory material 80 may not sufficiently protect the wall box 10 from the heat of the boiler interior volume 54. Insufficient protection from the heat is especially problematic with water cannon assemblies 70, such as the one shown in FIG. 2, due to the relatively large wall port 18 used to position the pivoting ball joint 64. Large wall ports 18 often have large areas exposed to the high temperatures of the boiler interior volume 54. Additionally, the passive heat-protection components may wear over time and provide diminishing protection for the wall box 10.

Figure 3:
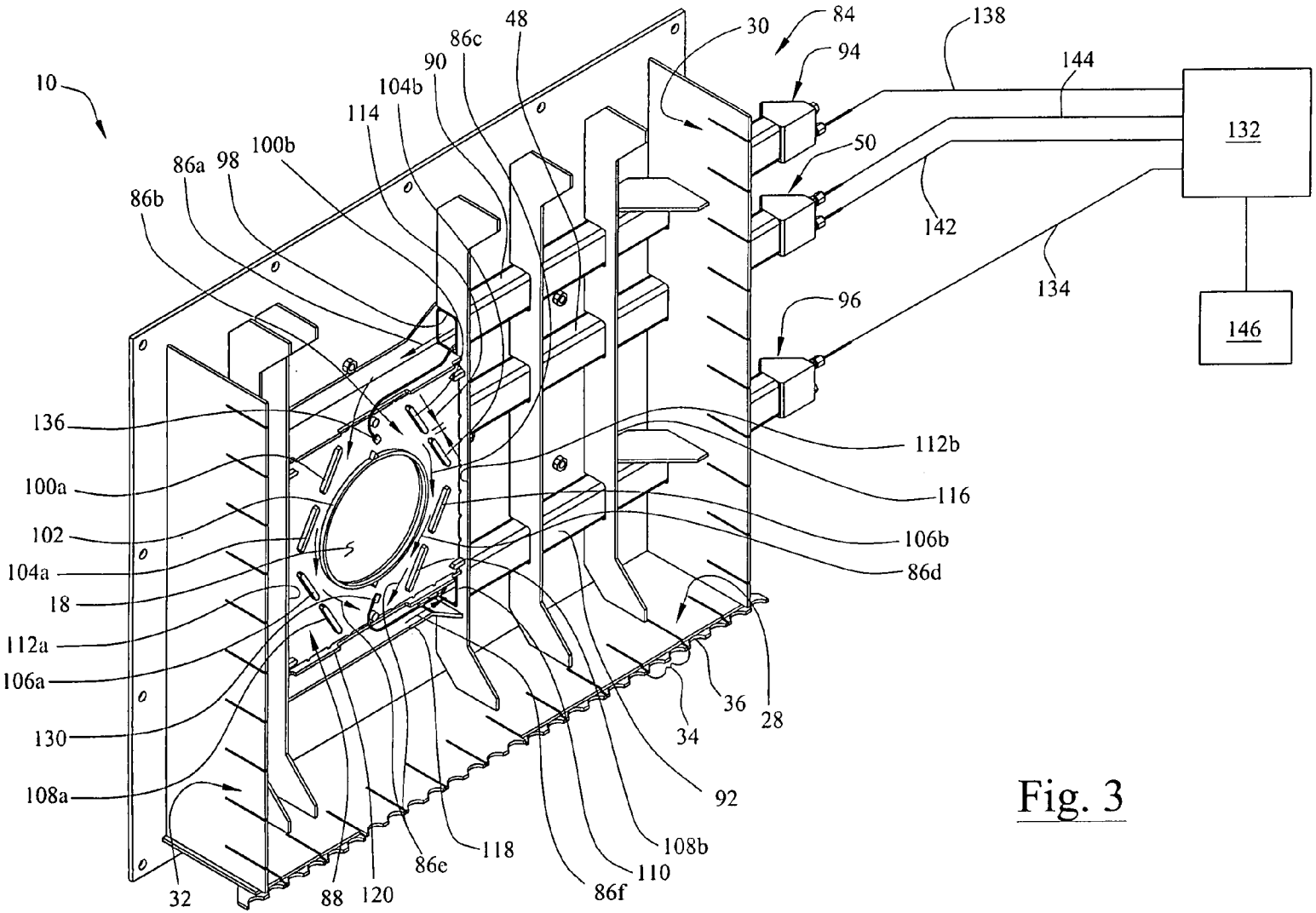
FIG. 3 is an isometric view of a wall box similar to the one shown in FIG. 1, wherein the wall box is in electrical connection with a controller, and wherein certain components of the wall box are removed for illustrative purposes.

FIGS. 2 and 3 show a cooling assembly 84 configured to adjust the operating temperature of the components adjacent to the wall port 18. The cooling assembly 84 includes a cooling chamber 88 defined by a cooling chamber surface 87. The cooling assembly 84 further includes a cooling fluid flowing through the cooling chamber 88 in order to absorb heat from the adjacent structures and lower their operating temperature. In order to maximize heat transfer, the cooling assembly 84 preferably receives a supply of cooling fluid having a temperature substantially less than the operating temperature of the adjacent components.

Referring to FIG. 1, in order to facilitate a supply of cooling fluid, the cooling assembly 84 is in fluid connection with an incoming cooling conduit 90 and an outgoing cooling conduit 92. The incoming cooling conduit 90 receives cooling fluid via an inlet 94 and supplies the cooling fluid to the cooling chamber 88. The cooling fluid next flows through the cooling chamber 88 into the outgoing cooling chamber 92. Next, the cooling fluid exits the cooling chamber 92 via an outlet 96.

Referring to FIG. 3, the flow of the cooling fluid through the cooling chamber 88 will now be discussed in more detail. First, a first flow path 86*a* of cooling fluid enters the cooling chamber 88 via a cooling chamber inlet 98. In this configuration, the cooling chamber inlet 98 is an end portion of the incoming cooling conduit 90. Next, a second flow path 86*b* of cooling fluid is directed towards the wall port 18 by a first pair of vanes 100*a*, 100*b*. The vanes 100*a*, 100*b* channel the cooling fluid into a desired flow path, as discussed in more detail below. The second flow path 86*b* of cooling fluid is prevented from entering the wall port 18 by a divider ring 102 surrounding the wall port 18 and having a height substantially equal to the height of the cooling chamber 88. Next a third flow path 86*c* of cooling fluid flows between a second pair of vanes 104*a*, 104*b* and the divider ring 102 in order to increase the flow rate of the cooling fluid in the area adjacent to the wall port 18. Next, a fourth flow path 86*d* of cooling fluid flows past a third pair of vanes 106*a*, 106*b*, and then a fifth flow path 86*e* of cooling fluid flows past a fourth pair of vanes 108*a*, 108*b*. Finally, a sixth flow path 86*f* of cooling fluid flows out of the cooling chamber 88 via an inlet 110.

The vanes 100*a*, 100*b*, 104*a*, 104*b*, 106*a*, 106*b*, 108*a*, and 108*b* preferably have a height substantially equal to the height of the cooling chamber 88 in order to maximize flow control. A material appropriate for the high boiler temperatures is preferably used to construct the vanes 100*a*, 100*b*, 104*a*, 104*b*, 106*a*, 106*b*, 108*a*, and 108*b*.

As shown in FIG. 3, the left side vanes 100*a*, 104*a*, 106*a*, and 108*a* are preferably spaced a predetermined distance from each other in order to optimize the various flow paths of the cooling fluid within the cooling chamber 88. More specifically, if the distance between respective vanes is relatively small, then a small amount of fluid will flow between the vanes and the flow rate of the cooling fluid in the flow path adjacent to the divider ring 102 will be substantially greater than the flow rate of the flow path near the left outer edge 112*a* of the cooling chamber 88. Similarly, the distance between the respective right side vanes 100*b*, 104*b*, 106*b*, and 108*b* will determine the flow rate of the cooling fluid in the flow path adjacent to the divider ring 102 and the flow rate of the flow path near the right outer edge 112*b* of the cooling chamber 88. For example, the distance 114 between the vane 100*b* and the vane 104*b* is related to the amount of cooling fluid that flows between the respective vanes, thus affecting the flow rate of the third flow path 86*c* of cooling fluid.

As shown in FIG. 3, the wall box 10 preferably includes a plurality of splines 116 extending substantially perpendicularly to the conduits 48, 90, 92 in order to properly position and support the conduits 48, 90, 92. The splines 116 also preferably provide support for the wall box 10. The splines 116 are preferably comprised of a heat resistant material, such as steel.

Referring now to FIGS. 2 and 3, the structure of the cooling assembly 84 will now be discussed. The channel adjacent to the outgoing cooling conduit inlet 110 is defined by a cooling chamber bottom wall 118 separating the cooling chamber 88 from the refractory material 80 and a divider wall 120 separating the cooling chamber 88 from the sealing chamber 52. The cooling chamber 88 is further separated from the sealing chamber 52 in the area adjacent to the wall port 18 by a divider wall 122 and the divider ring 102.

Additionally, the cooling chamber 88 is further separated from the refractory material 80 in the area near the wall port 18 by a cooling chamber front wall 124 having an inner surface 126 in the cooling assembly 84. The cooling chamber 88 is preferably defined by a plurality of plates (the divider ring 102, the outer edges of the cooling chambers 112*a*, 112*b*, the cooling chamber bottom wall 118, the divider wall 120, the divider wall 122, and the cooling chamber front wall 124) integrally formed via a coupling method such as welding. However, the cooling chamber 88 may be defined by a single, unitary structure formed by an appropriate method, such as casting, molding, or stamping.

In order to prevent the cooling fluid from damaging the cooling chamber 88, the components defining the cooling chamber 88 are preferably comprised of a non-corrosive material, such as stainless steel. Similarly, the components defining the sealing chamber 52 are also preferably comprised of a non-corrosive material, such as stainless steel.

The cooling assembly 84 shown in FIGS. 2 and 3 may further include an assembly for actively cooling portions of the wall box 10 in response to a parameter, such as a temperature, being measured in an area adjacent to the portion of the wall box 10 to be actively cooled. More specifically, at least one sensor, such as a thermocouple may be provided to measure an operating temperature proximal to the wall box 10. The sensor(s) may be placed within the cooling chamber 88, the sealing chamber 52 or another appropriate location.

An inner cooling sensor 128 is shown in FIG. 2 being mounted to the inner surface 126 of the cooling chamber front wall 124 in order to measure the operating temperature of the cooling chamber front wall 124 in the area adjacent to the wall port 18. The cooling chamber 88 preferably also includes an outer cooling chamber sensor 130 mounted to the divider wall 122 in order to measure a second operating temperature within the cooling chamber 88. Referring now to FIG. 3, the inner cooling chamber sensor (not shown in FIG. 3) and the outer cooling chamber sensor 130 are electrically connected to a controller 132 via an electrical wire 134. The controller 132 is configured to actively control the flow rate of cooling fluid through the cooling chamber 88 based on the measurements from the respective sensors 128, 130.

As shown in FIG. 3, a second outer cooling chamber sensor 136 is mounted to the divider wall 122 on the opposite side of the divider ring 102 from the outer cooling chamber sensor 130. The second outer cooling chamber sensor 136 is electrically connected to the controller 132 by an electrical wire 138. Similarly, a second inner cooling chamber sensor (not shown) is mounted to the inner surface 126 of the cooling chamber front wall 124 on the opposite side of the divider ring 102 from the inner cooling chamber sensor 128. The inner cooling chamber sensor 128 and the second inner cooling chamber sensor are respectively electrically connected to the controller 132 by the electrical wires 134, 138. Alternatively, the inner cooling chamber sensor 128 and the second inner cooling chamber sensor may be connected to the controller 132 by additional electrical wires (not shown). These four respective sensors cooperate to provide the controller 132 with information regarding the cooling assembly 84 temperature at various locations.

The sealing chamber 52 may also include at least one temperature sensor in order to measure the operating temperature of the wall box 10. As shown in FIG. 2, a wall box sensor 140 is mounted to the divider wall 122 within the wall box chamber 52. A second wall box sensor (not shown) may also be mounted to the divider wall 122 within the sealing chamber 52 on the opposite side the divider ring 102 from the wall box sensor 140. The wall box sensor 140 and the second wall box sensor are respectively electrically connected to the controller 132 by wires 142 and 144 in order to provide the controller 132 with information regarding the operating temperature of the wall box 10.

As shown in FIG. 3, the wires 134, 138, 142, 144 preferably run along the inner surfaces of the respective conduits 48, 90, 92. However, alternative constructions may be used as appropriate. Additionally, the respective sensors may include a wireless connection with the controller 132, eliminating the need for the electrical wires 134, 138, 142, 144. The controller 132 may be any appropriate device that is able to receive and process temperature signals and adjust a parameter of the cooling means, such as the flow rate of the cooling fluid, in response thereto.

The controller 132 may also be in electrical connection with a warning device 146 such as a flashing warning light or a warning siren. The warning device 146 is programmed to send an audio or a visual warning to the appropriate system user if the wall box 10 reaches a predetermined warning temperature.

Various configurations may be used for operating the cooling assembly 84. In one configuration, the cooling fluid is supplied continuously to the cooling chamber 88 regardless of the operating temperature of the wall box 10. This configuration does not necessarily include sensors to measure the operating temperature of the wall box 10.

In another configuration of the cooling assembly 84, the cooling fluid is only supplied when a predetermined event occurs, such as the operating temperature of the wall box 10 reaching a predetermined cooling temperature. The predetermined cooling temperature may be equal to or unequal to the predetermined warning temperature depending on user preferences. During this configuration, the wall box 10 preferably includes temperature sensors similarly to those discussed above. Another predetermined event that may activate the cooling fluid flow is a component failure, such as a failure of the heat shields 38, 40 the crotch plate 44, or the refractory material 80. Failure of respective components may be determined by the temperature sensors described above, or by other appropriate methods such as sensors connected to the respective components.

In yet another configuration of the cooling assembly 84, the cooling fluid is regulated by a manual control, such as a control knob (not shown). The control knob may be configured to adjust any appropriate characteristic of the cooling fluid, such as flow rate, fluid temperature, or fluid content. The control knob may also be an override switch that is used to override the controller 132. The control knob is especially beneficial during periods of maintenance on the wall box 10 because the boiler tubes 12 and the water cannon lance tube 72 do not necessarily conduct fluid flow during these periods.

In another configuration of the present invention, equally applicable to each of the above described configurations, the controller 132 controls a parameter of the cooling fluid other than the flow rate, such as the fluid temperature or the fluid composition. For instance, the controller 132 may include a cooler (not shown) in order to sufficiently cool the cooling fluid based on the cooling chamber surface 87 operating temperature. Furthermore, the controller 132 may include a mixer to inject various different fluids into the stream of cooling fluid based on the operating temperature of the wall box 10. Preferably, the cooling fluid is tempering air during relatively low wall box 10 operating temperatures, it is compressed air during medium wall box 10 operating temperatures, and it is moist air having a higher cooling potential during relatively wall box 10 operating temperatures. Alternatively, the various different fluids may have different heat-absorbing properties, and they may include combinations of water, air, and refrigerants.

It is therefore intended that the foregoing detailed description be regarded as illustrative rather than limiting, and that it be understood that it is the following claims, including all equivalents, that are intending to define the spirit and scope of this invention.

What is claimed is:

1. A wall box coupled with a wall port of a combustion device, the combustion device including a wall being a plurality of steam tubes and an interior volume defined by the wall, wherein the wall port extends through the wall, the wall box defining:

a cooling chamber surrounding the wall port, wherein the cooling chamber provides for transfer of a fluid for cooling the wall box and is substantially sealed from fluid communication with the interior volume of the combustion device and the steam tubes.

2. The wall box in claim 1, wherein the fluid is configured to enter the cooling chamber via an inlet and to exit the cooling chamber via an outlet, the fluid being configured to absorb heat from the cooling chamber surface.

3. The wall box in claim 2, wherein a plate defines the cooling chamber surface, me plate being located between the cooling chamber and the interior volume of the combustion device, wherein the fluid located in the inlet has an inlet fluid temperature and the plate has a plate temperature, find the inlet fluid temperature is lower than the plate temperature.

4. The wall box in claim 2, further comprising at least one vane located within the cooling chamber, the at least one vane configured to direct the fluid from the inlet of the cooling chamber to the outlet of the cooling chamber.

5. The wall box in claim 1, further comprising at least one temperature sensor located within the cooling chamber.

6. The wall box in claim 1, wherein a cleaning device extends into the wall port, wherein the cleaning device is configured to eject a cleaning fluid into the interior volume of the combustion device.

7. The wall box in claim 1, the wall port permitting penetration of the wall by a cleaning lance.

8. A wall box coupled with a wall port of a combustion device, the combustion device including a wall being a plurality of steam tubes and an interior volume defined by the wall, wherein the wall port extends through the wall and permits the penetration of the wall by a cleaning lance, the wall box defining:

a cooling chamber surrounding wall port, wherein the cooling chamber provides for transfer of a fluid for cooling the wall box; and a sealing chamber located adjacent to the wall port, wherein the sealing chamber includes a sealing chamber inlet and a sealing chamber outlet for sealing a junction between the wall port and the cleaning lance, wherein the sealing chamber outlet is in fluid communication with the interior volume of the combustion device.

9. The wall box in claim 8, wherein at least a portion or the cooling chamber is located between the interior volume of the combustion device and the sealing chamber.

10. The wall box in claim 8, wherein the combustion device interior volume includes combustion device gas, and the sealing chamber includes a sealing fluid exiting the sealing chamber outlet at a sealing fluid velocity, wherein the sealing fluid velocity is sufficient to substantially prevent the combustion device gas from entering the sealing chamber via the sealing chamber outlet.

11. The wall box in claim 10, the cleaning lance having a spherical head inserted into the wall box.

12. The wall box in claim 11, wherein the sealing fluid flows around the spherical head to substantially prevent debris from collecting thereon.

13. A cooling assembly coupled with a combustion device having a wall defining an interior volume, a wall port extending through the wall, cooling assembly comprising:

a temperature sensor located adjacent to the wall port and configured to obtain an operating temperature;

a cooling chamber surface defining a cooling chamber located adjacent to the wall port, the cooling chamber configured to receive a cooling fluid via an inlet, the cooling fluid configured to adjust the operating temperature; and a controller configured to control a characteristic of the cooling fluid.

14. The cooling assembly in claim 13, wherein the controller is in electrical connection with the temperature sensor and the controller is configured to actively control the characteristic of the cooling fluid based on the operating temperature.

15. The cooling assembly in claim 14, wherein the temperature sensor is coupled with the cooling chamber surface and located within the cooling chamber.

16. The cooling assembly in claim 15, further including a second temperature sensor located within the cooling chamber and configured to obtain a second operating temperature, the controller being in electrical connection with the second temperature sensor and configured to actively control the characteristic of the cooling fluid based on the second operating temperature.

17. The cooling assembly in claim 13, wherein the characteristic of the cooling fluid is a flow rate of the cooling fluid.

18. The cooling assembly in claim 13, further comprising a warning device in electrical connection with the controller, the warning device configured to provide a warning signal if the operating temperature reaches a critical temperature.

19. The cooling assembly in claim 13, wherein the cool ng chamber includes an inlet located exterior to the combustion device interior volume and an outlet located exterior to the combustion device interior volume.

20. A cooling assembly coupled with a combustion device having a wall defining an interior volume, a wall port extending through the wall, cooling assembly comprising:

a temperature sensor located adjacent to the wall port and configured to obtain an operating temperature;

a cooling device configured to adjust the operating temperature; and a controller in electrical connection with the temperature sensor, wherein the controller is configured to actively control the cooling device based on the operating temperature.

21. The cooling assembly in claim 20, wherein the cooling device receives a cooling fluid having a flow rate, and the controller actively controls the flow rate of the fluid based on the operating temperature.

* * * * *

UNITED STATES PATENT AND TRADEMARK OFFICE

CERTIFICATE OF CORRECTION

PATENT NO. : 6,925,969 B1
DATED : August 9, 2005
INVENTOR(S) : Clinton A. Brown et al.

It is certified that error appears in the above-identified patent and that said Letters Patent is hereby corrected as shown below:

Title page,
Item [56], References Cited, U.S. PATENT DOCUMENTS,
delete "3,743,916" and substitute -- 3,742,916 --.

Column 10,
Line 2, after "chamber surface," delete "me" and substitute -- the --.
Line 5, after "a plate temperature," delete "find" and substitute -- and --.

Column 12,
Line 1, after "claim 13, wherein the" delete "cool ng" and substitute -- cooling --.

Signed and Sealed this

Twenty-third Day of May, 2006

JON W. DUDAS
*Director of the United States Patent and Trademark Office*